US007455438B2

(12) United States Patent
Repetto et al.

(10) Patent No.: US 7,455,438 B2
(45) Date of Patent: Nov. 25, 2008

(54) MODULE FOR PROJECTING A LIGHT BEAM, AN OPTICAL DEVICE FOR THE MODULE, AND A VEHICLE FRONT LIGHT ASSEMBLY

(75) Inventors: Piermario Repetto, Orbassano (IT); Stefano Bernard, Orbassano (IT); Denis Bollea, Orbassano (IT); Davide Capello, Orbassano (IT)

(73) Assignee: C.R.F. Societa Consortile Per Azioni (IT)

( * ) Notice: Subject to any disclaimer, the term of this patent is extended or adjusted under 35 U.S.C. 154(b) by 155 days.

(21) Appl. No.: 11/128,163

(22) Filed: May 13, 2005

(65) Prior Publication Data

US 2005/0276061 A1 Dec. 15, 2005

(30) Foreign Application Priority Data

May 14, 2004 (EP) ..... 04425346

(51) Int. Cl.
*F21V 7/00* (2006.01)

(52) U.S. Cl. ..... 362/516; 362/514; 362/298; 362/341; 362/517; 362/518; 362/349; 362/297; 362/304; 362/346

(58) Field of Classification Search ..... 362/514, 362/516, 341, 517, 518, 349, 297, 298, 304, 362/346

See application file for complete search history.

(56) References Cited

U.S. PATENT DOCUMENTS

| | | | | |
|---|---|---|---|---|
| 4,698,730 | A | 10/1987 | Sakai et al. | |
| 5,727,874 | A | 3/1998 | Yamamoto et al. | |
| 7,059,731 | B2 * | 6/2006 | Lee et al. | 353/99 |
| 2003/0202359 | A1 | 10/2003 | Albou | |
| 2004/0042212 | A1 | 3/2004 | Du et al. | |
| 2005/0057940 | A1 | 3/2005 | Capello et al. | |

FOREIGN PATENT DOCUMENTS

| | | | |
|---|---|---|---|
| DE | 195 07 234 | A1 | 9/1996 |
| EP | 0 798 788 | A1 | 10/1997 |
| EP | 1 357 333 | A2 | 10/2003 |
| EP | 1 418 381 | A2 | 5/2004 |
| EP | 1 505 339 | A1 | 2/2005 |
| WO | WO 00/24062 | | 4/2000 |
| WO | WO 00/36336 | A1 | 6/2000 |
| WO | WO 03/048367 | A1 | 6/2003 |

* cited by examiner

*Primary Examiner*—Stephen F. Husar
*Assistant Examiner*—Jessica L McMillan
(74) *Attorney, Agent, or Firm*—Cook Alex Ltd.

(57) ABSTRACT

A module for projecting a light beam comprises a light source and a substantially flat support surface on which the source is arranged in a manner such as to emit light from only one side of the surface, and a reflector for reflecting the light emitted by the source. The reflector comprises a curved reflecting surface which extends on one side of the support surface, has a concavity facing towards the support surface, and can reflect the light coming from the source in a principal direction substantially parallel to the support surface of the source. An optical device for a module according to the invention and a vehicle front light assembly comprising a plurality of modules according to the invention form further subjects of the invention.

38 Claims, 14 Drawing Sheets

MODULE FOR PROJECTING A LIGHT BEAM, AN OPTICAL DEVICE FOR THE MODULE, AND A VEHICLE FRONT LIGHT ASSEMBLY

BACKGROUND OF THE INVENTION

The present invention relates to a module for collimating a light beam.

A module of this type is known, for example, from U.S. Pat. No. 4,698,730 which describes a module comprising an LED with a radial-type package, mounted on a support, and an optical element operating with total internal reflection. The optical element has a substantially cylindrical recess in which the lens which acts as a package for the LED is housed. The device is characterized in that part of the beam emitted by the LED is collimated by the lens which constitutes its package whilst another portion of the beam is collimated by a reflector of substantially parabolic cross-section.

Other solutions similar to this have been proposed, for example, in patent application WO00/24062, in which the collimation function is performed by a transparent dielectric module which houses the LED source in a suitable, substantially cylindrical recess; as in the previous case, a portion of the beam is collimated by a reflector of substantially parabolic cross-section and operating with total internal reflection whilst a second portion is collimated by a lens the first surface of which is constituted by the upper surface of the recess.

Further variations of the same concept are put forward in patent applications EP 0 798 788, DE 195 07 234, WO00/36336, and WO03/048637.

In some applications, the devices described above have limited versatility. Various solutions for producing optical units which use solid-state light sources, in particular LEDs, are under investigation in the automotive sector. In these applications, particularly with regard to headlights with a dipping function, the light beams projected must satisfy certain requirements which are imposed by the standards that are in force on the subject.

In the case of dipped headlights, the divergence of the beam projected is particularly critical for the regions of the headlight which project the light towards the zone of the distribution that is close to the horizon (see, for example, FIG. 1) where the standard provides for a very sharp transition from the maximum or peak of the distribution, at an angle of 1-2 degrees below the horizon and intensity values close to zero above the horizon line. For dipped headlights according to the European standard, the distribution of luminous intensity adopts the characteristic form shown in FIG. 1 in which the lines join points of equal luminous intensity; the demarcation line in the region of the horizon is known as the cut-off line. In the European dipped beam, the cut-off line has an indentation on the right-hand side, forming an angle of about 15 degrees with the axis of the horizon. This indentation is absent in the American dipped beam and in the UK and Japan it is reversed horizontally.

Owing to the particular structure of the collimator used, the devices described above do not permit the production of optical units in which the light distribution produced can be regulated precisely in order to adapt it to the different patterns of illumination required by the standards. Moreover, in all of the solutions described above, the focal length of the lens (operating on a portion of the beam emitted by the LED) must be kept to the minimum if an excessive increase in the dimensions of the module is to be avoided; since the divergence θ of the beam emerging from the collimator is generally determined by the linear extent of the source (d) and by the focal length (f), by the equation $\theta=\arctan(d/f)$, the solutions described above do not enable the divergence to be reduced below a threshold value, obtaining the cut-off specified, without an excessive increase in the dimensions of the module.

There are also known headlights which, in order to obtain the cut-off in the distribution, use a so-called poly-ellipsoidal reflector configuration, as shown schematically in FIG. 2. In accordance with this configuration, a support plate P of a light source S also acts as a diaphragm for screening some of the light radiation reflected by a reflecting surface R with an elliptical profile. The emerging radiation is then refracted by a lens L.

The limitation of this configuration is its low efficiency owing to the presence of the diaphragm which absorbs some of the light radiation focused by the poly-ellipsoidal reflector.

SUMMARY OF THE INVENTION

This object is achieved according to the invention by a module for projecting a light beam. In particular, the shape of the curved reflecting surface, which does not completely surround the source, permits a more accurate design of the reflecting surface than in lenses of the prior art, and with greater simplicity. Moreover, the large support surface for the light source can provide for effective dispersal of the heat generated by the source.

This object is achieved according to the invention by a module for projecting a light beam having the characteristics defined in Claim 1. In particular, the shape of the curve reflecting surface, which does not completely surround the source, permits a more accurate design of the reflecting surface than in lenses of the prior art, and with greater simplicity. Moreover, the large support surface for the light source can provide for effective dispersal of the heat generate by the source.

Preferred embodiments of the invention are defined in the dependent claims.

Further subjects of the invention are a vehicle front light assembly comprising a plurality of modules according to the invention and an optical device for a module according to the invention.

BRIEF DESCRIPTION OF THE DRAWINGS

Some preferred but non-limiting embodiments of the invention will now be described with reference to the appended drawings, in which.

DETAILED DESCRIPTION OF THE INVENTION

Figure 3:
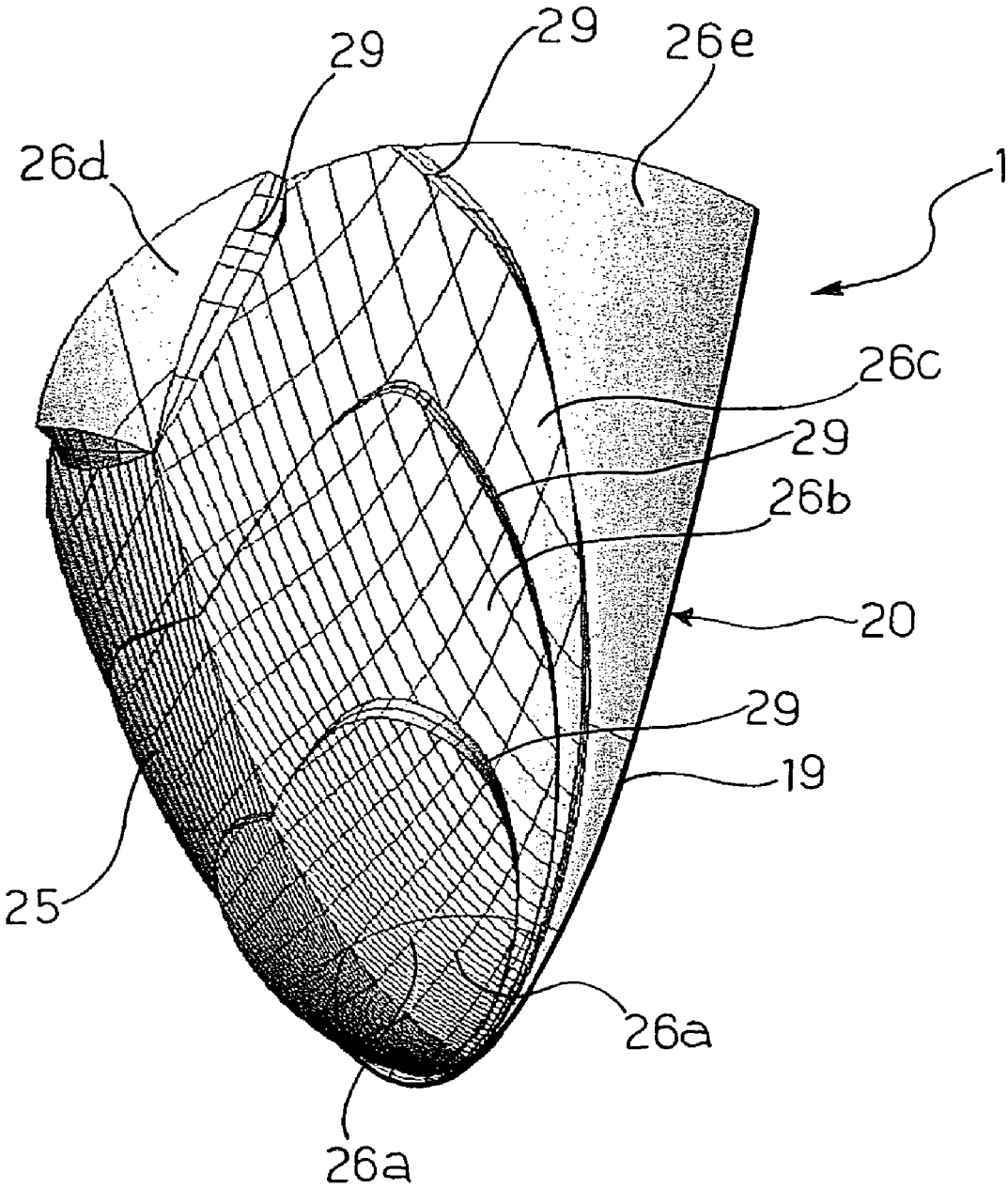
FIG. 3 is a schematic, perspective view of a module for projecting a light beam according to the present invention.
Figure 4:
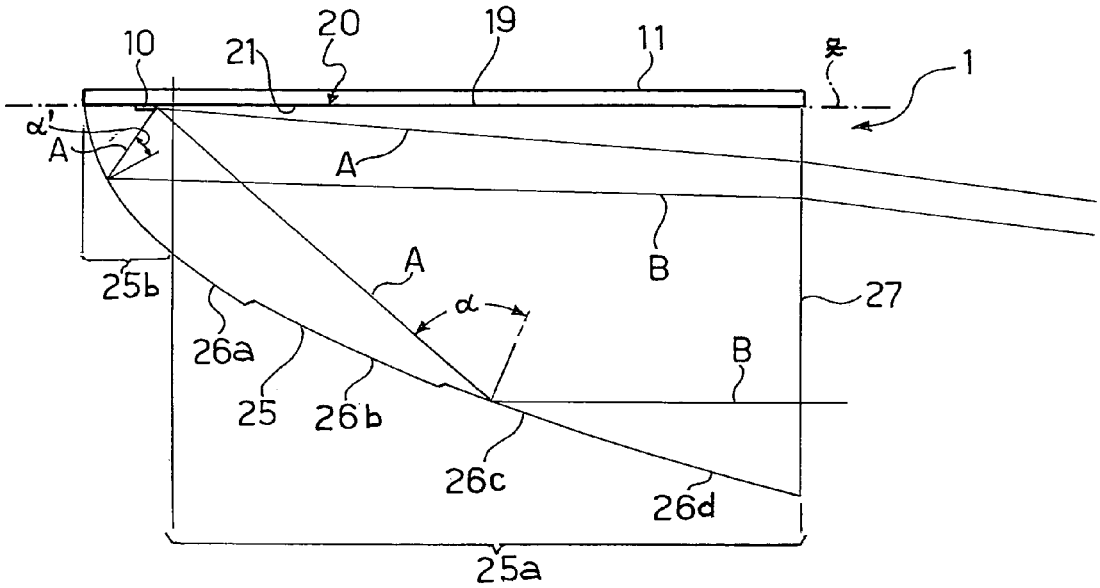
FIG. 4 is a longitudinal section through the device of FIG. 3.

FIGS. 3 and 4 show a module 1 for projecting a light beam according to the invention. The module 1 comprises a light source 10 and an optical device 20 with which the source 10 is coupled. For this purpose, the optical device 20 is constituted by a transparent dielectric body which has:

i) a first surface 19 which is coupled with a substantially flat support surface 21 on which the source 10 is arranged in a manner such as to emit light solely in the direction of the optical device;

ii) a second, curved reflecting surface 25 having a concavity facing towards the support surface 21. The reflecting surface 25 is designed in a manner such that at least some of the light coming from the source 10 in radially outward directions represented by the rays A is reflected by the surface 25 in different directions B which, however, stray little from a condition of parallelism with the support surface 21. In other words, the inclination of the reflected rays B is such that they cannot subsequently fall on the support surface 21. A light beam is thus created which has a principal axis substantially parallel to the support surface 21 of the source 10;

iii) a third, flat surface 27 by means of which the beam is refracted and leaves the device 1.

A module of the above-mentioned type is suitable for forming a basic unit of a vehicle front light assembly (shown in FIG. 18) having a plurality of modules according to the invention, each comprising a source formed by an LED or by a matrix of LEDs. The assembly can shape the luminous flux emitted by the plurality of LED sources, which may be of the chip type (without packages) or with packages of the SMD (Surface Mounted Device) type, or even with packages optimized for high flux (for example, Lumileds' Luxeon I, III and V models with maximum powers of 1, 3 and 5 watts, respectively), so as to form a predetermined distribution of luminous intensity, for example, that which satisfies the standards that are in force for dipped headlights.

In the embodiment of FIGS. 3 and 4, the basic module 1 is a solid body formed by transparent dielectric material, for example, PMMA (polymethyl methacrylate), the refractive index n of which determines the limit angle of incidence $\theta_1$ above which Total Internal Reflection (hereinafter TIR) takes place in accordance with the following law:

$$\sin(\theta_l) = \frac{1}{n}$$

if the device is immersed in air. In the case in question, since PMMA has a refractive index n≈1.49 in the visible light range, this gives a limit angle $\theta_1 \approx 42.220$ .

The module 1 has substantially the shape of a paraboloid of revolution sectioned in a plane extending through the axis of revolution z; the LED source 10, for example, in chip form, is disposed on the support surface 21, that is on the flat face which is formed by sectioning the paraboloid, and is positioned approximately at the focus of the paraboloid; the LED 10 in chip form typically has a square or rectangular emitter and a Lambertian emission lobe with emission from a single face of the emitter. This is achieved by mounting the emitter on a reflective metal track (not shown) formed on the support surface 21; the function of the track is triple: i) to carry current to the LED, ii) to dissipate the heat generated by the junction, iii) to reflect the light which is emitted by the LED towards the support surface 21.

The support surface 21 in general forms part of a plate 11 which, in a preferred embodiment, is a printed circuit board (PCB). In this case, the conductive track is typically formed by a lithographic process.

Figure 6:
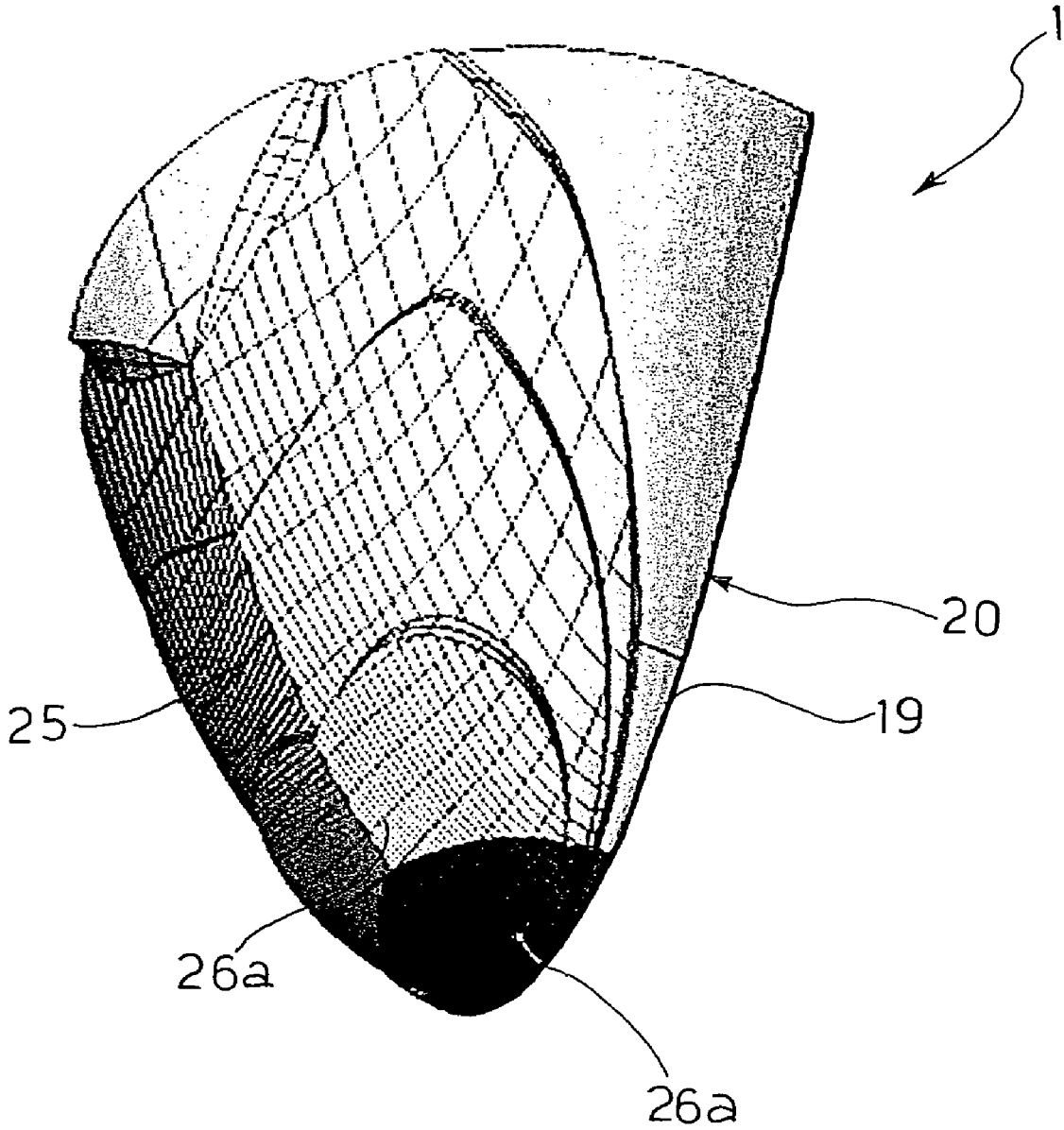
FIG. 6 is a view identical to that of FIG. 3 in which a particular region of the device is shown.

Some of the light rays A emitted by the source 10 are reflected by the reflecting surface 25; this reflection takes place in two different ways, depending on the geometry of the interaction between each light ray A and the interface which separates the device 1 from the surrounding area:

1. the angle of incidence a of the ray A, calculated with respect to the local perpendicular to the surface 25, is greater than the limit angle $\theta_1$; total internal reflection (TIR) conditions exist and reflection takes place with total energy conservation. This condition occurs on most of the reflecting surface 25 (that is, in the region indicated 25*a* in FIG. 4);
2. the angle of incidence $\alpha'$ is less than the limit angle $\theta_1$; local reflectivity is notably low (but not zero and can be evaluated by Fresnel's equations) and it is therefore necessary to provide for the region concerned (indicated 25*b* in FIG. 4 and shown in particular in FIG. 6) to be covered with a coating of reflective material (for example, aluminium) which increases the reflectivity to typical values of 80%.

Figure 7:
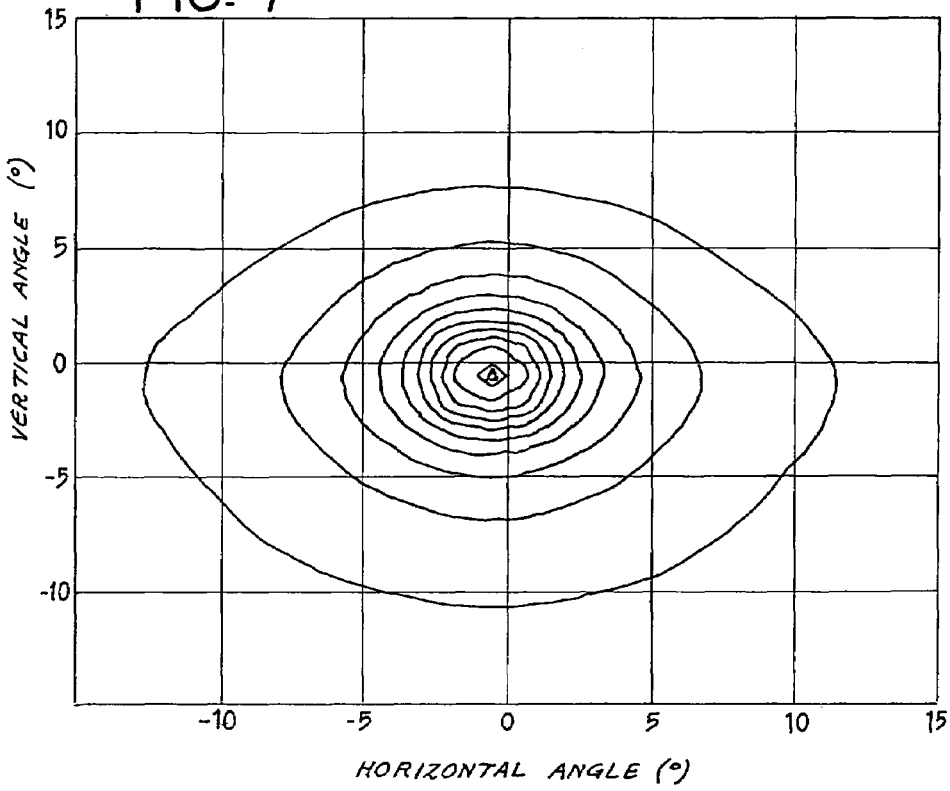
FIG. 7 is a graph which illustrates a distribution of luminous intensity formed by a paraboloid headlight according to the invention.

If the reflecting surface 25 of the device 1 were strictly a paraboloid and the source 10 were a point source, the beam emerging from the device would be collimated and the distribution of luminous intensity would be substantially dot-like and coinciding with the direction of the axis z of the device 1; the fact that the source is extensive (in the case of Lumileds' Luxeon model, for example, the emitter is a square with 1 mm sides) introduces a divergence which depends substantially on the size of the source and on the focal length of the paraboloid. This is illustrated clearly in FIG. 7 which shows a graph of the distribution of luminous intensity formed by a semi-paraboloid module in which the module 1 has a depth of 36 mm with a square emitter with 1 mm sides.

If the emitter has a rectangular shape, in order to optimize the distribution of luminous intensity, the longer side of the emitter is advantageously oriented perpendicularly relative to the axis of revolution z.

Figure 9A:
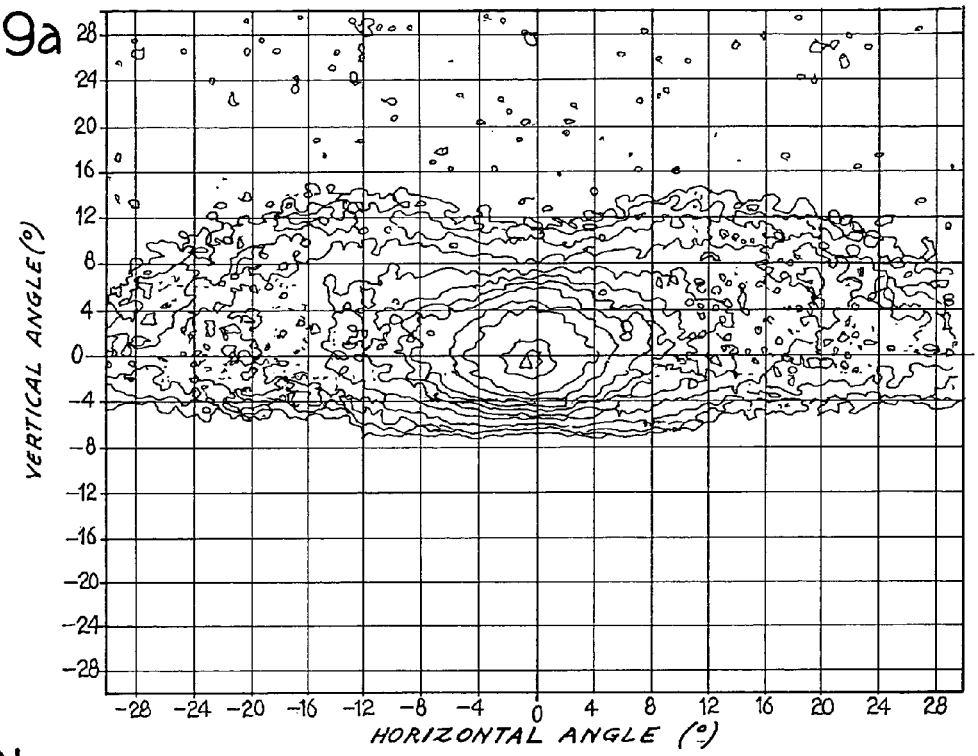
FIGS. 9*a*, 9*b* and 9*c* are graphs which illustrate distributions of the luminous intensity in different light-source arrangements in the device of FIG. 2.
Figure 9B:
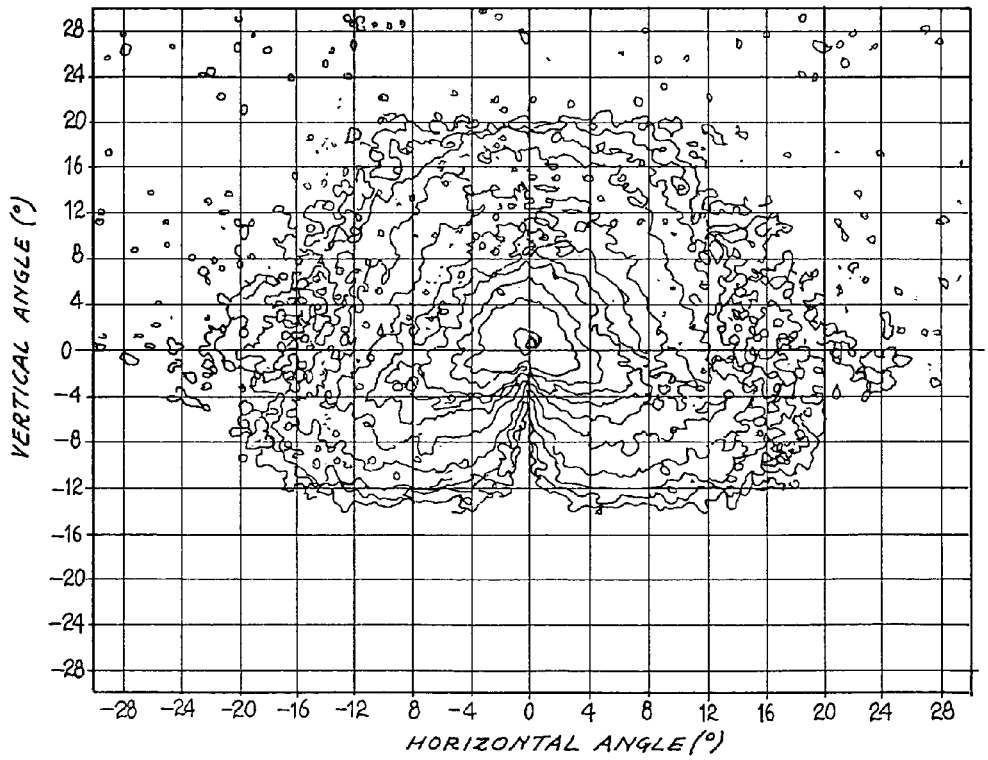

This is done to minimize the spread, as is clear from FIGS. 9*a* and 9*b*. In fact, FIG. 9*a* shows a distribution of the luminous intensity for a rectangular emitter with its longer side perpendicular to the axis z of the device 1, and FIG. 9*b* shows a distribution of the luminous intensity for a rectangular emitter with its longer side parallel to the axis z of the device 1.

Figure 2:
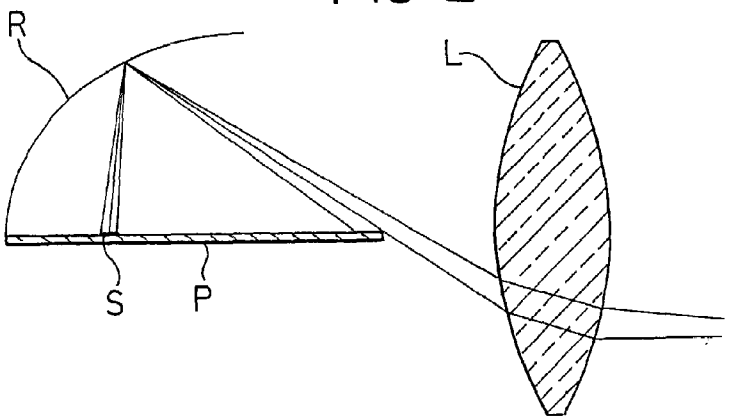
FIG. 2 is a diagram which illustrates the operation of an optical configuration according to the prior art.
Figure 5:
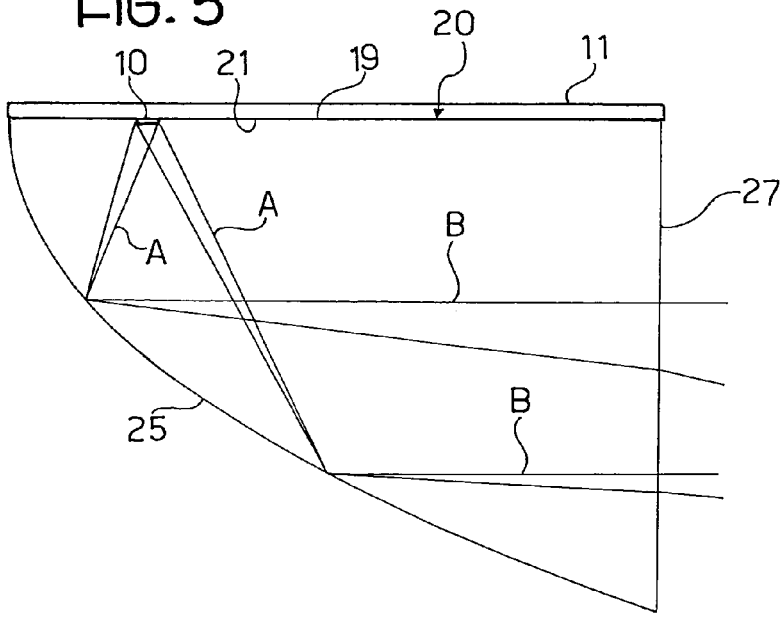
FIG. 5 is a section through a variant of the device of FIG. 4.
Figure 9C:
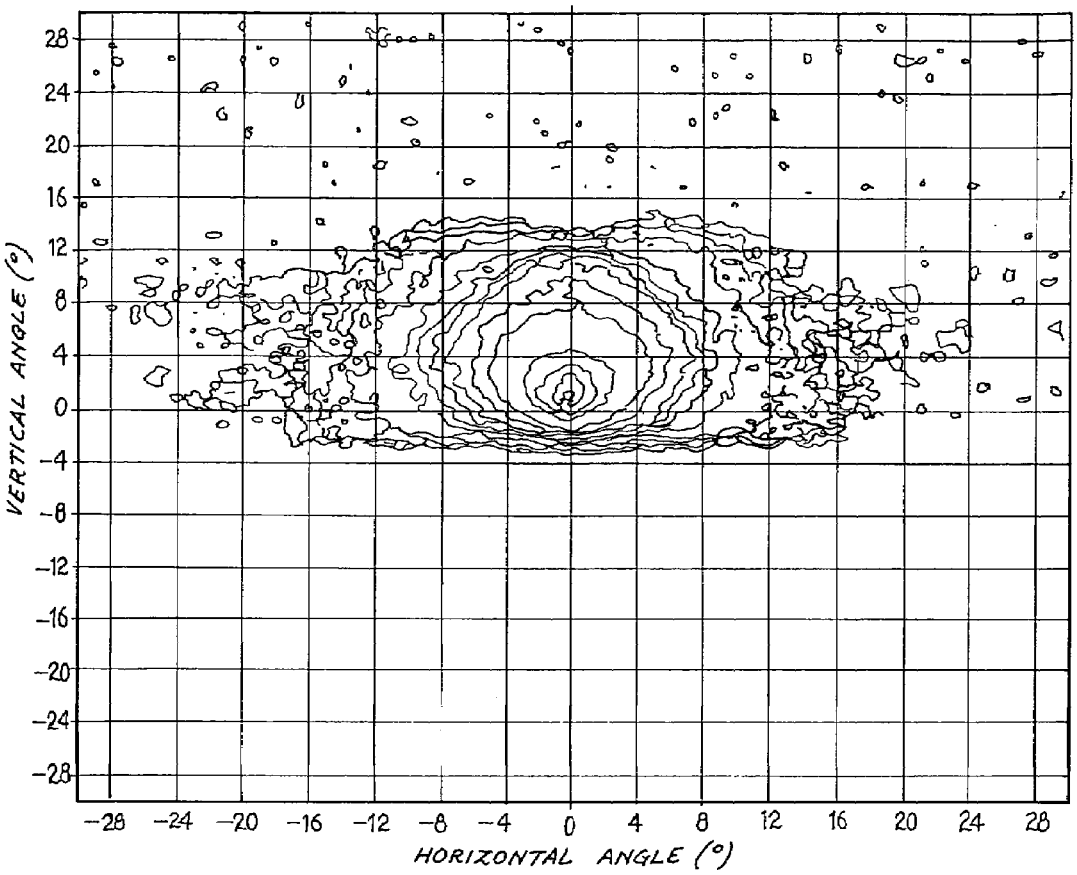

The light distribution produced by the headlight also depends on the position of the source 10. FIG. 5 shows a module 1 which is similar from many points of view to that of FIG. 2 with the difference that, instead of being centred on the focus of the paraboloid, the source 10 is arranged so as to have one side on the focus. FIG. 9*c* shows the light distribution produced by a module 1 having the configuration of FIG. 5.

It is pointed out that, in general, different regions of the reflecting surface 25 contribute to a different extent to the divergence of the emerging beam, the divergence at any point of the reflecting surface 25 being defined in general as the angle subtended by the source 10 at that point of the surface 25. "Vertical divergence" or "spread" at a given point of the surface 25 defines herein the maximum vertical angle subtended by the source 10 at that point, where vertical direction means hereinafter the direction substantially perpendicular to the horizon and horizontal direction means that substantially parallel to the horizon, in a condition of use of the module. In the drawings, the horizontal direction is parallel to the support surface 21 and the vertical direction is that of the plane containing the cross-section of FIG. 4.

Figure 8:
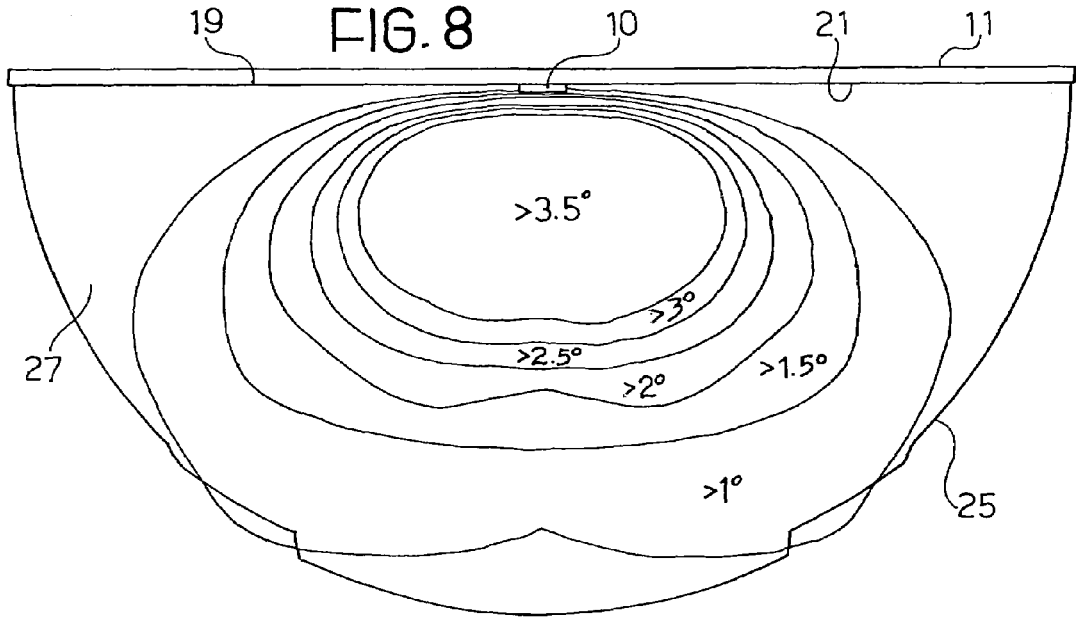
FIG. 8 is a front view of the device of FIG. 3, in which areas with particular vertical divergence values are shown.

FIG. 8 is a front view of the device 1 with a possible subdivision of the reflecting surface 25 into areas having predetermined spread values.

Figure 1:
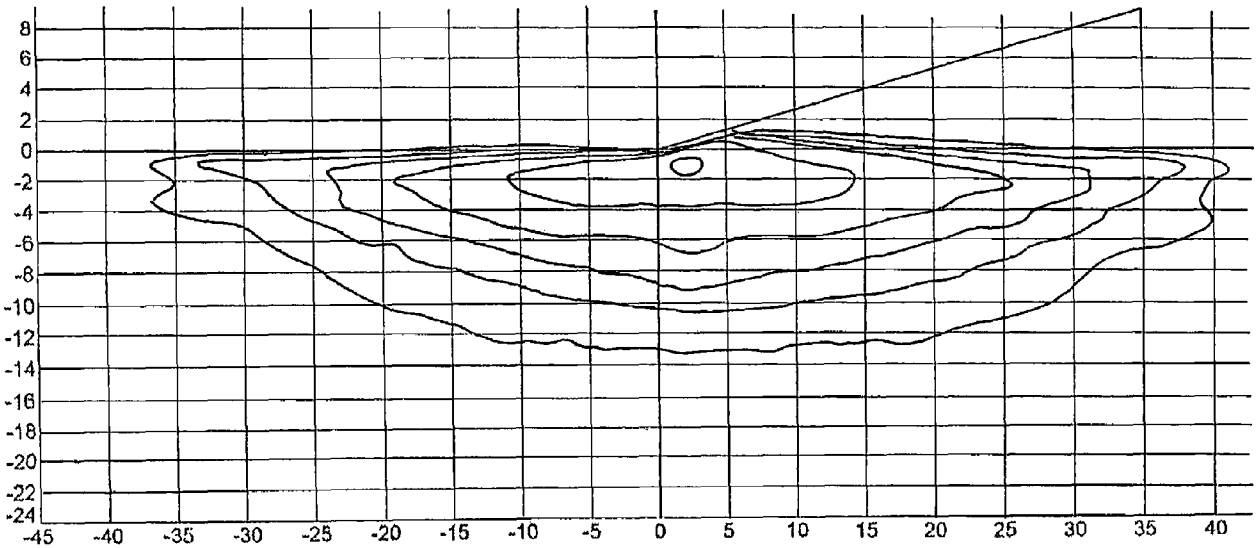
FIG. 1 is a graph which illustrates a typical distribution of the luminous intensity for a dipped headlight according to European standards.

For dipped headlights, the spread is particularly critical for the regions of the reflecting surface 25 which reflect the light towards the zone of the distribution that is close to the cut-off line (see FIG. 1).

According to a preferred configuration of this invention, the sharp cut-off in the intensity distribution, as provided for by the standards, is obtained by a combination of several measures:

1) the LED 10 is positioned on the lower face of an electronic circuit board which coincides with the plate 11 so that the light which is emitted directly by the LED and which does not fall on the reflecting surface 25 is nevertheless directed below the horizon;
2) the paraboloid is divided into sectors 26*a, b, c, d, e*, each sector having an axis of symmetry which is inclined downwards by an angle equal to half of the spread in that sector; and/or
3) the parabolic profile is divided into sectors which have greater horizontal divergence the greater is the vertical divergence in that sector so as to minimize the intensity contribution of that sector in the vicinity of the cut-off line.

The optimal method for defining the shape of these sectors is to define the loci of the points at which the spread adopts a constant value; these loci of points are curves which are defined herein as "isospread" curves and the reflector regions included between two successive "isospread" curves represent the above-mentioned sectors.

As demonstrated by the Applicant and claimed in European patent application EP 1 505 339, this approach permits maximum control of the distribution and optimization of the cut-off.

Figure 10:
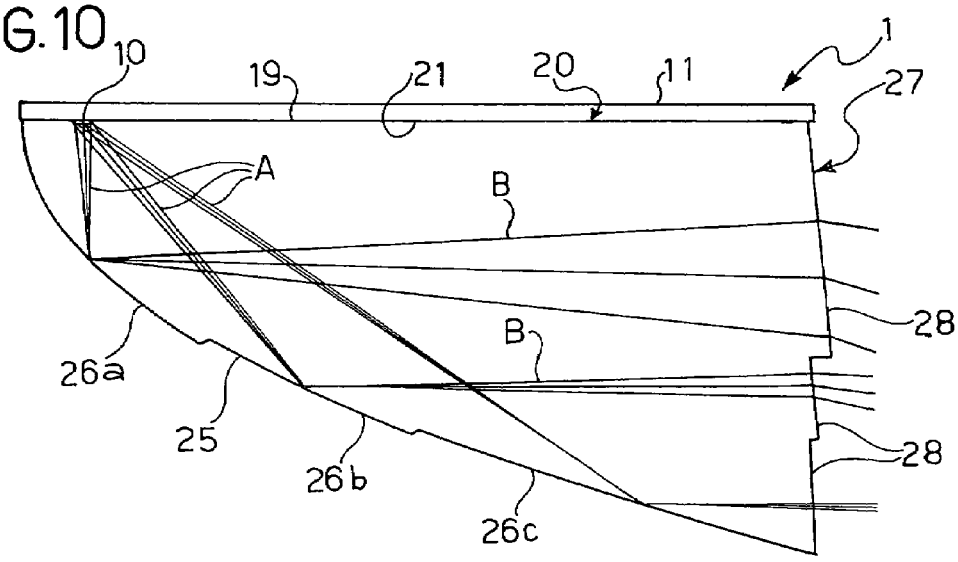
FIG. 10 is a longitudinal section through a variant of the device of FIG. 4 in which the operation of the device is illustrated.

In an alternative embodiment (not shown), each of the sectors 26*a, b, c, d, e* is shaped in accordance with conventional techniques other than the "isospread" curves technique but in any case so as to form a rectangular distribution of luminous intensity, the shorter side of that distribution being defined by the spread, but the longer side being set by the designer. Each sector may also be inclined vertically by an angle equal to half of the corresponding spread so as to reduce the intensity above the horizon to zero. Alternatively or in addition, irrespective of the type of segmentation used for the reflecting surface 25, a prismatic component operating in a similar manner to the inclination of the axes of symmetry of the sectors 26*a, b, c, d, e* may be introduced on the flat face 27 at the output from the device 1; this solution requires a segmentation of the flat face into sectors 28 each associated with a corresponding sector 26*a, b, c, d, e* of the reflecting surface 25 and having a different prismatic component such as to tilt the beam downwards by an angle equal to half of the spread. The sectors 28 on the flat face 27 can be obtained by projecting the isospread curves of the reflector onto the surface of that face (see FIG. 10).

The design principle upon which the device 1 is based is the building-up of the desired distribution of luminous intensity as a superimposition of the distributions produced by the individual sectors 26*a, b, c, d, e*; those having smaller spreads contribute to the zone of the distribution with greater gradients and vice versa. In the embodiment described, the sectors of the surface 25 corresponding to smaller spreads (that is, the sector 26*c* in the example considered) are calculated to produce a very narrow rectangle characterized by a large gradient of luminous intensity in the vertical direction (these sectors will thus help to move the intensity peak towards the horizon and increase its value); the sectors corresponding to larger spreads (for example, greater than 30°, such as the sector 26*a* in the example) are calculated to produce wider rectangles with a vertical profile of luminous intensity with a smaller gradient. If necessary, the sectors with smaller spreads may be shaped in accordance with a suitably oriented paraboloid portion in order further to increase the value of the intensity peak.

Figure 11:
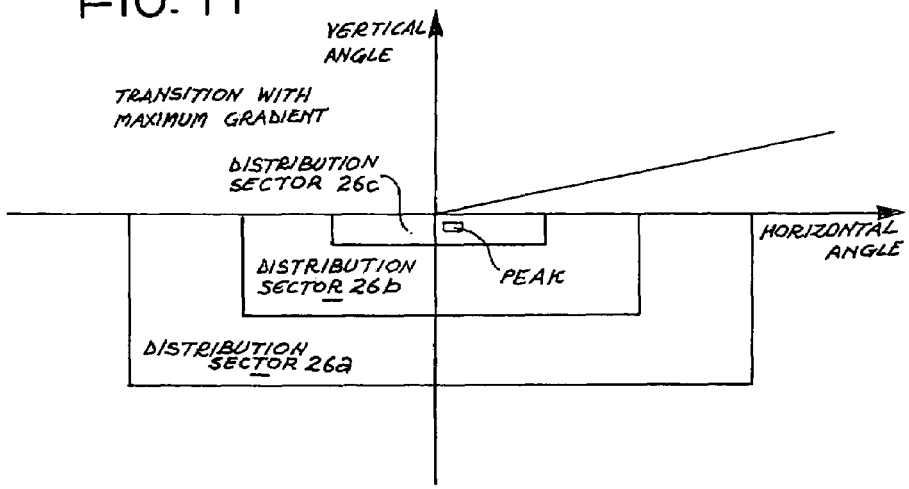
FIG. 11 is a schematic graph which illustrates the superimposition of partial distributions of luminous intensity produced by different portions of the device of FIG. 3.
Figure 12:
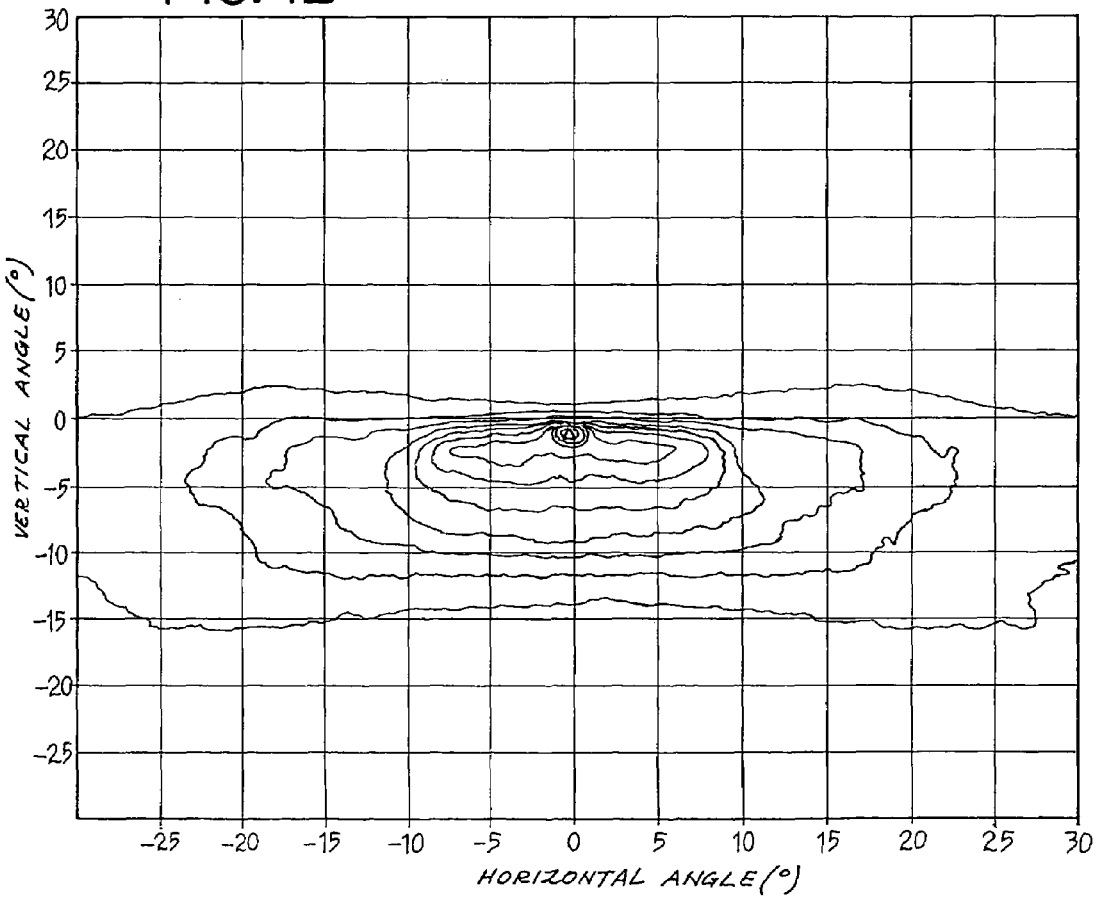
FIG. 12 is a graph which illustrates the distribution of luminous intensity formed by the device of FIG. 3.

In order to obtain the distribution shown in FIG. 1, the regions 26*d*, and disposed close to the output of the module, which are also those that are characterized by a smaller spread, may be shaped so as to shape the incident flux into a rectangular distribution with a width, for example, of 10° and a height equal to the spread (see FIGS. 11 and 12). In contrast, the sectors 26*a, b*, which are closer to the source and which are characterized by larger spreads, may be shaped so that the reflected radiation forms a rectangular distribution, for example, with a width of 60° and a height equal to the spread angle. These sectors help to increase intensity in the right-hand or left-hand portion of the distribution. Since the standards provide for the presence of a peak in the overall distribution, this can be achieved by shaping the sector 26*e* which is farthest from the source in accordance with a paraboloid portion having its focus in the centre of the source 10. The junctions 29 between the surfaces of the sectors 26*a, b, c, d, e,* which are generally characterized by more less marked discontinuity, are formed so as to minimize the portion of flux emitted by the source 10 which is incident thereon.

Figure 13:
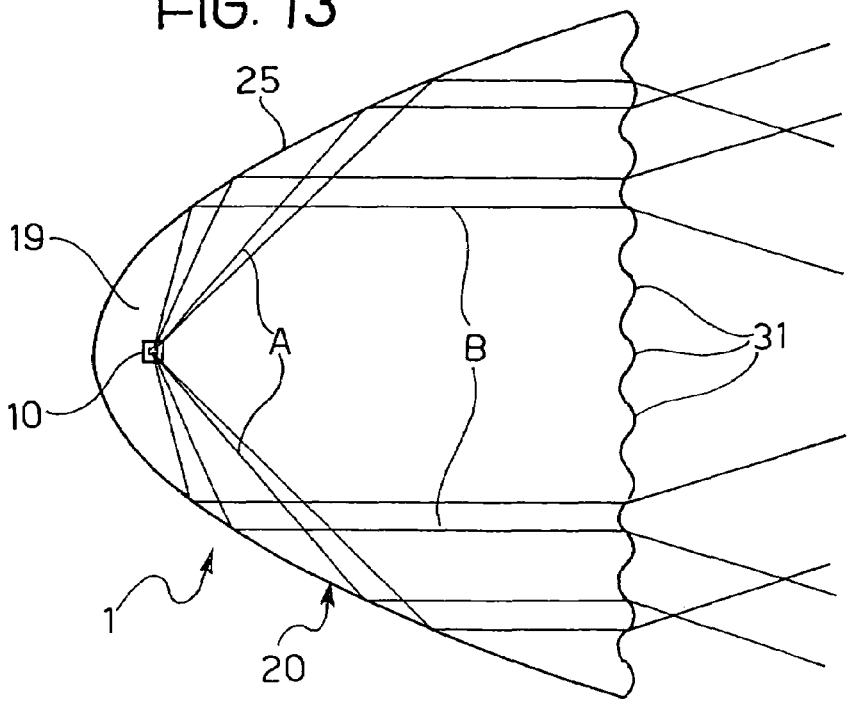
FIG. 13 is a plan view of a further variant of the device of FIG. 3, FIGS. 14 to 17 illustrate different variants of the device of FIG. 3 with regard to the arrangement of the light source.

Preferably, most of the sectors 26*a, b, c, d, e* have the shape of a paraboloid segment the axis of which is inclined downwards by an angle substantially equal to half of the spread in that segment; the resulting overall distribution will be substantially collimated both in the horizontal direction and in the vertical direction but with an intensity peak which is displaced upwards. In this configuration, the required horizontal divergence can be achieved with the use of a cylindrical lens or a matrix of cylindrical micro-lenses on the flat face 27 at the output of the device 1, the axes of these lenses being perpendicular to the road surface. These micro-lenses may be diverging or converging, or may be sinusoidal 31 (converging-diverging, as shown in FIG. 13) in order to reduce the amount of light diffused.

The flat face 27 at the output of the device 1 may be subdivided into sectors obtained by projecting the isospread curves of the reflector onto the surface of the face 27, each sector having a matrix of micro-lenses operating to produce a greater horizontal divergence the greater is the spread associated with that sector.

Figure 14:
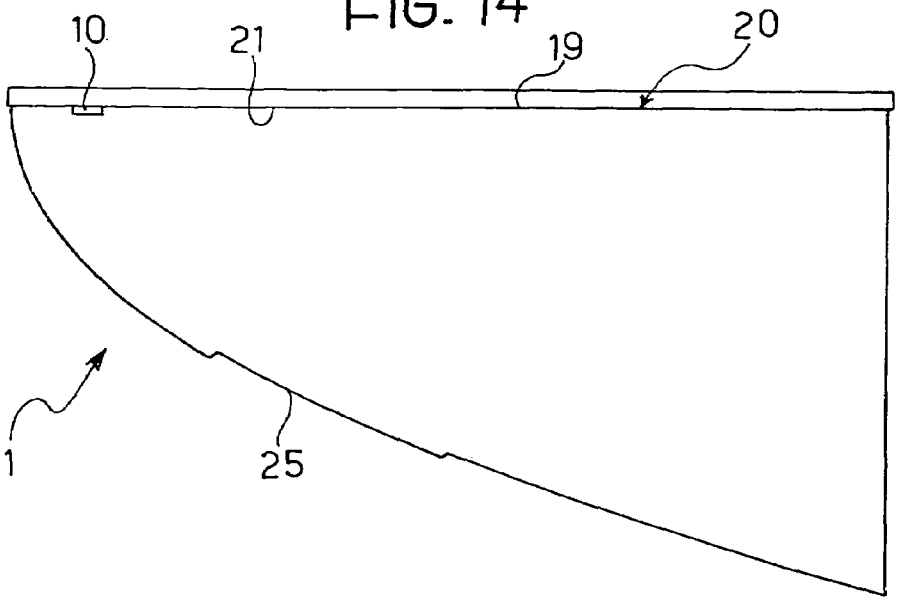
Figure 15:
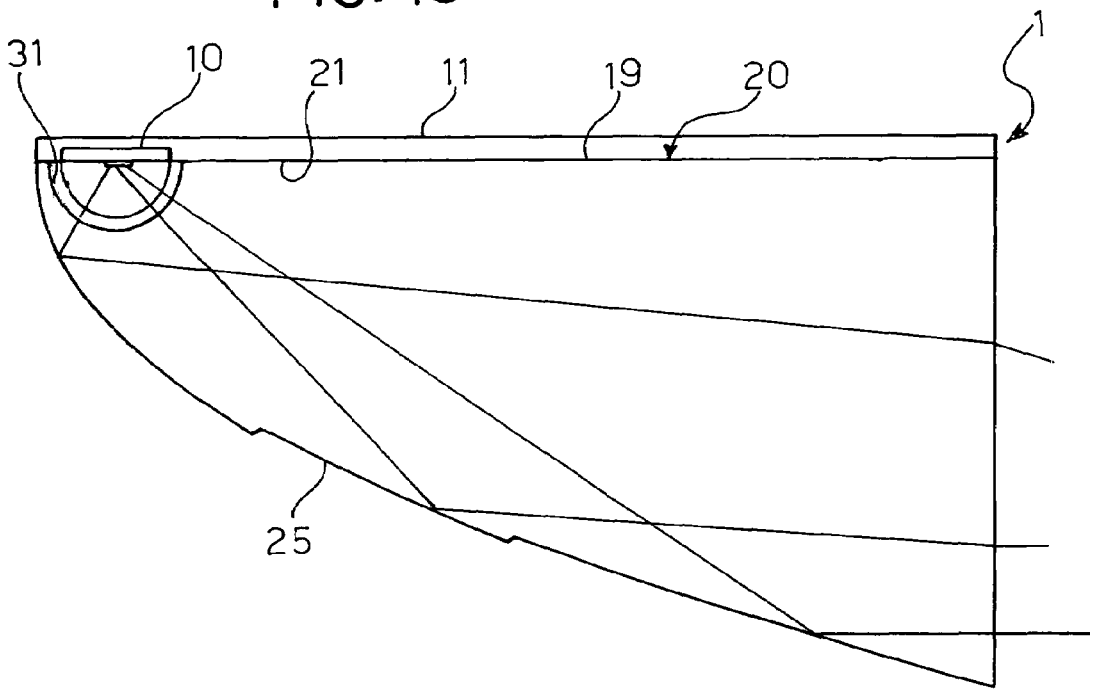

The positioning of the LED source 10 depends on the type of source used, with regard to the selection to use a LED source in chip form (without the resin lens which constitutes its package) or with a package. In particular, this positioning may take place by:

1) direct immersion of the emitter 10 in the dielectric constituting the module 1, as shown in section in FIG. 14. The advantage of this configuration is that the number of dielectric-glass interfaces, and hence the Fresnel losses, is limited to one;
2) the production, in the module 1, of a recess 31*a* of a shape such as to receive the packaging of the LED 10. For a Lambertian package, this configuration enables the optical aberrations introduced by the two interfaces to be minimized, thus maximizing the luminous intensity of the module (see FIG. 15).

Figure 16:
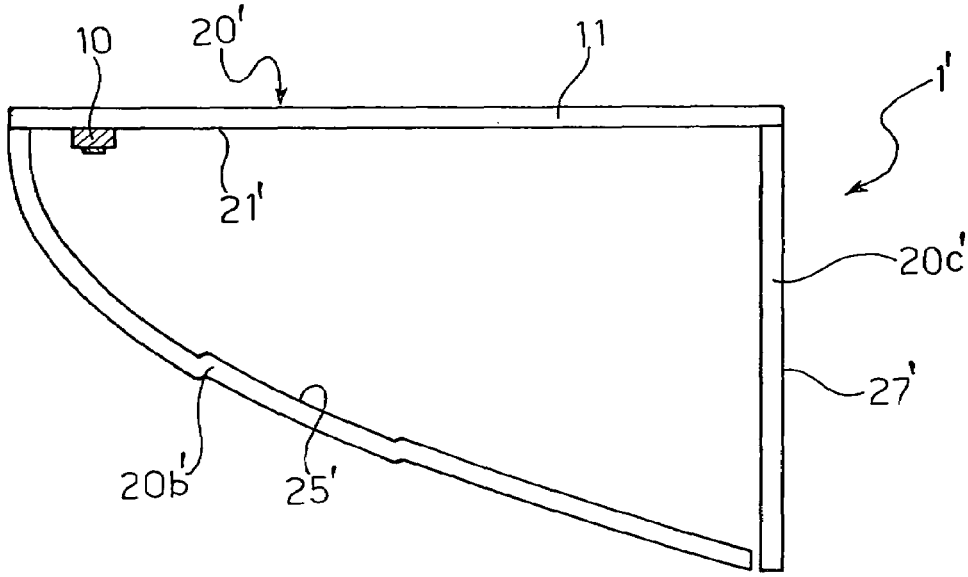

In a variant shown in FIG. 16, the module 1' differs from the module 1 in that the optical device 20' is constituted by a reflecting wall 20*b*' having a curved internal face which defines the reflecting surface 25', the wall being arranged on the support surface 21' of the source 10. The wall 20*b*' is formed by a shell of plastics material covered on the internal surface 25' with a metallic or multi-layer dielectric reflective coating. In this variant, there may be a third wall 20*c*' of transparent material which has the output face 27' for the light beam. The rays are thus propagated in air and not, as in the previous embodiment, in a dielectric, and the reflections do not take place by TIR but with the loss of energy due to the non-unitary reflectance of the coated surfaces. Otherwise, the surfaces are shaped in accordance with the design lines described above. The plate 11 on which the source 10 is mounted is formed, for example, by an electronic circuit board.

Figure 17:
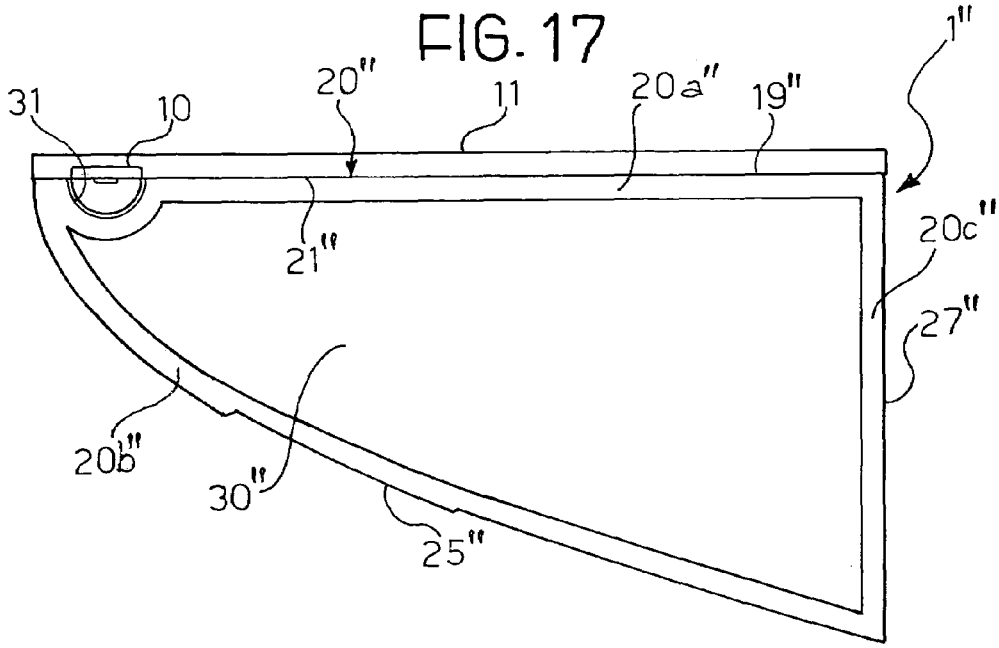

In a variant shown in FIG. 17, the device 1" differs from the device 1 in that the first wall 20*a*" which is coupled with the support surface 21", the second wall 20*b*", and the third wall 20*c*" form a transparent shell. In this shell, the outer reflecting surface 25" is shaped in accordance with the design lines described above, and the internal cavity 30" is filled with a liquid or gel with a refractive index coinciding with that of the material constituting the outer shell. It is thus possible to produce a module having optical properties wholly similar to those of the device 1 shown in FIG. 4, but with simplified moulding of the device 1.

The process for the moulding of the device according to 1" will require the moulding of a shell constituted by any 2 of the 3 surfaces 20*a*", 20*b*" and 20*c*", preferably the surfaces 20*b*" and 20*c*"; the missing surface is moulded or processed separately and subsequently glued to the moulded shell after the cavity 30" has been filled with liquid or gel.

Alternatively, the filling can be done after the gluing, through a suitable hole formed in one of the walls 20*a*", 20*b*" and 20*c*". The process limits the problems connected with so-called "shrinkage" of the material during the cooling stage, which are particularly significant with large volumes of material such as those of the device 1; this shrinkage would involve the risk of a substantial change in the external profile and possible non-homogeneities which could modify the optical path of the rays emitted by the source 10. In this preferred embodiment, the reflection on the outer surface 25" would still be based on TIR, whilst there is still the possibility of providing for the region close to the source 10 to be covered with a reflective coating.

In general, the flux emitted by a single LED cannot ensure the minimum values required for the distribution of luminous intensity provided for by the standards that are in force; it is therefore necessary to superimpose the luminous intensity distributions produced by several LEDs (for dipped headlights, for example, 12-20 LEDs may be necessary) each coupled with its own optical module.

Figure 18:
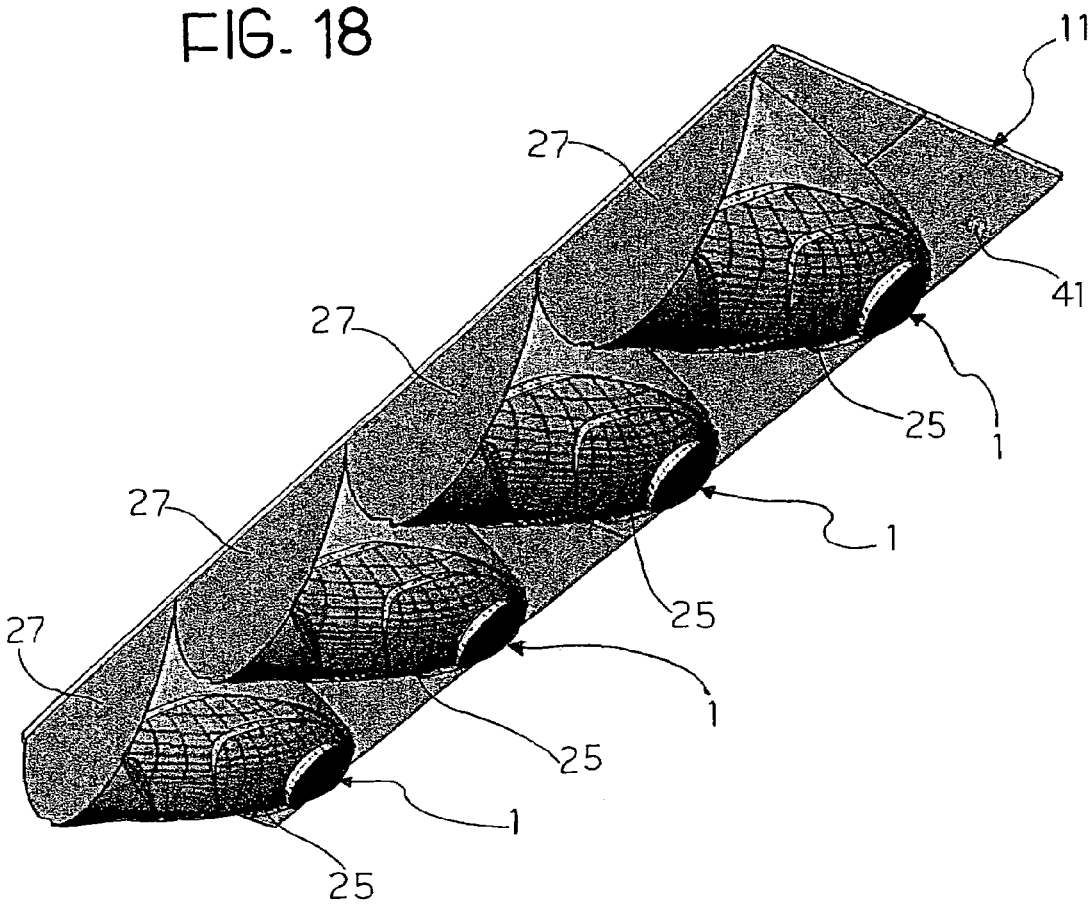
FIG. 18 is a perspective view of a light assembly comprising a plurality of modules according to the invention.

In a configuration shown in FIG. 18, the set of LEDs 10 is distributed on the lower face 41 of a single substrate 11 which is intended to be arranged parallel to the road surface and on which electrical supply tracks are deposited (for example, by silk-screen printing or by lithographic techniques), or on the lower faces of several substantially parallel substrates, each LED being coupled with the respective optical module. To minimize the flux above the horizon line, the modules 1 are fixed to the lower faces of the substrates.

With reference to FIG. 1, the indentation which forms an angle of 15° with the horizon line and which, in the European standard, is on the right-hand side of the luminous intensity distribution, may be produced 1) by dedicating one or more sectors of each individual device to the formation of the indentation and/or 2) by dedicating one or more devices in their entirety to the formation of the indentation.

Figure 21:
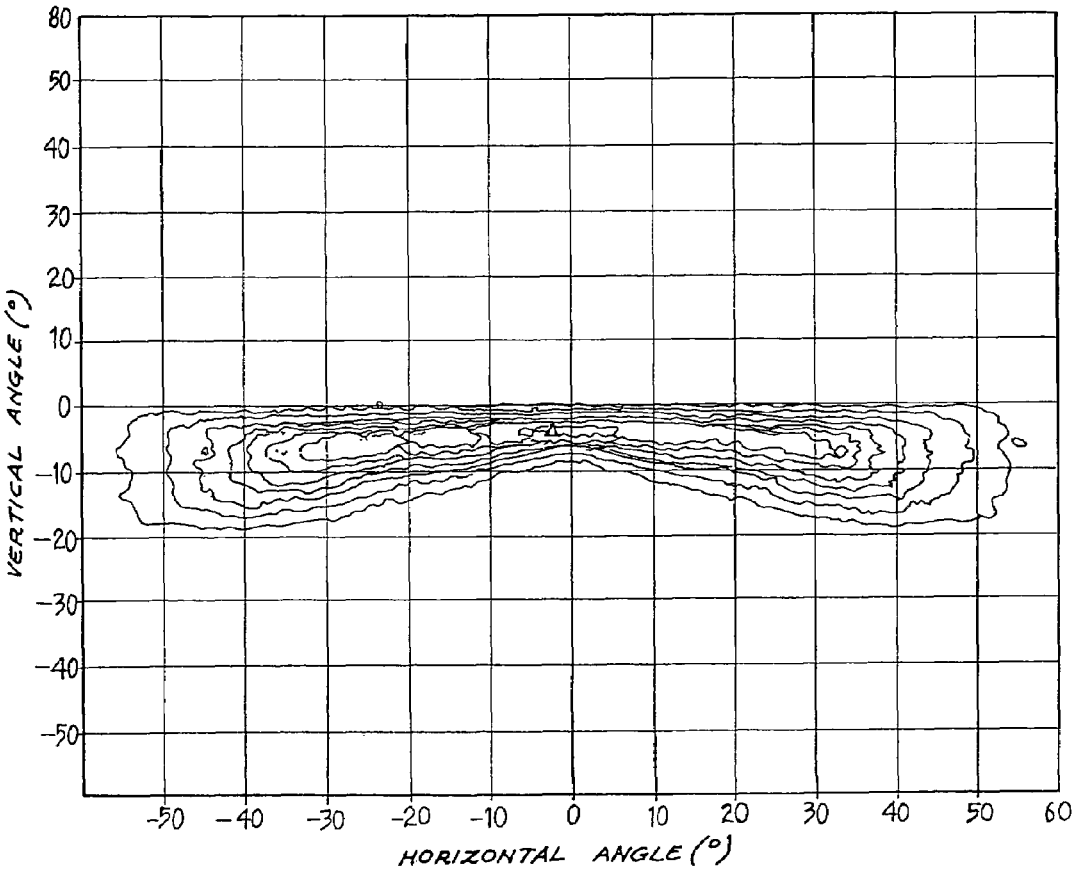
FIG. 21 is a graph which illustrates the distribution of luminous intensity formed by the device of FIG. 19.
Figure 19:
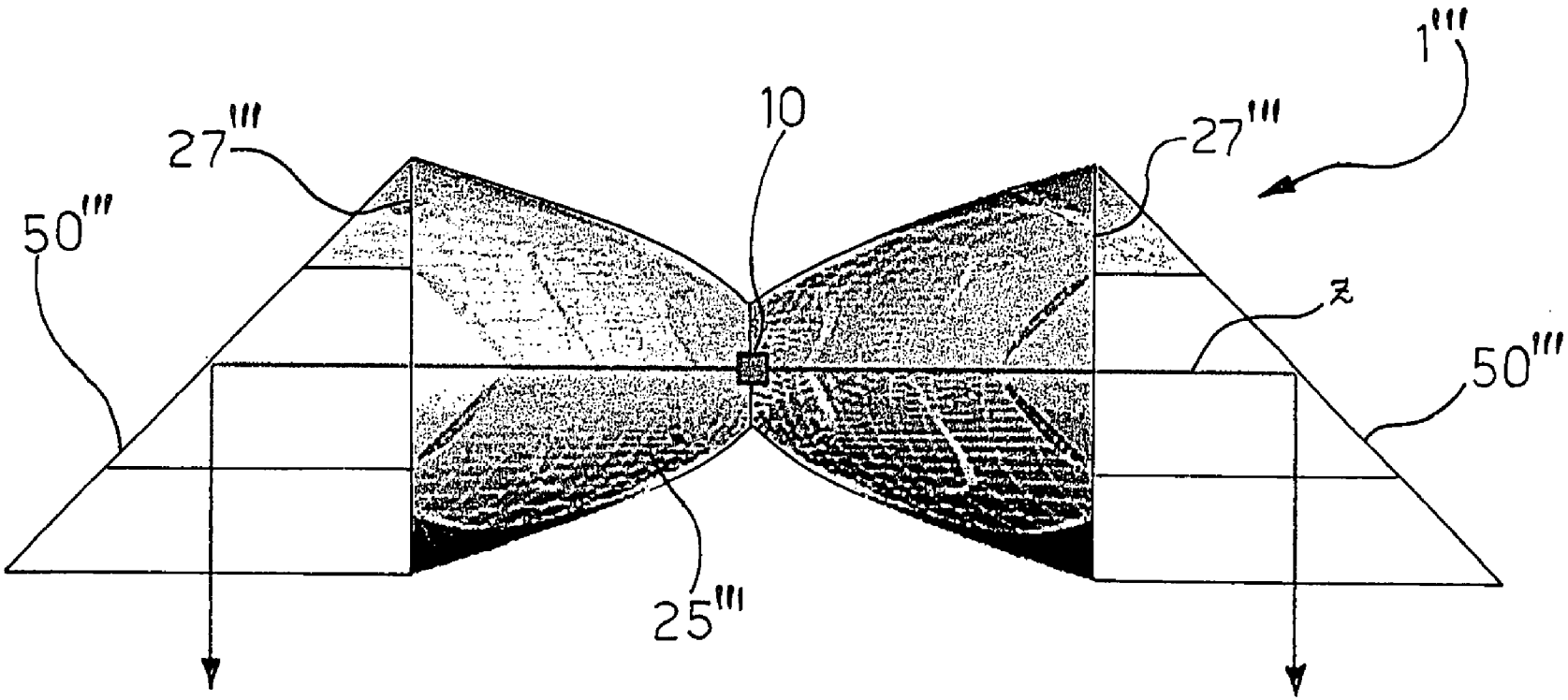
FIG. 19 is a plan view of a device for projecting a light beam, formed by two modules according to the invention.
Figure 20:
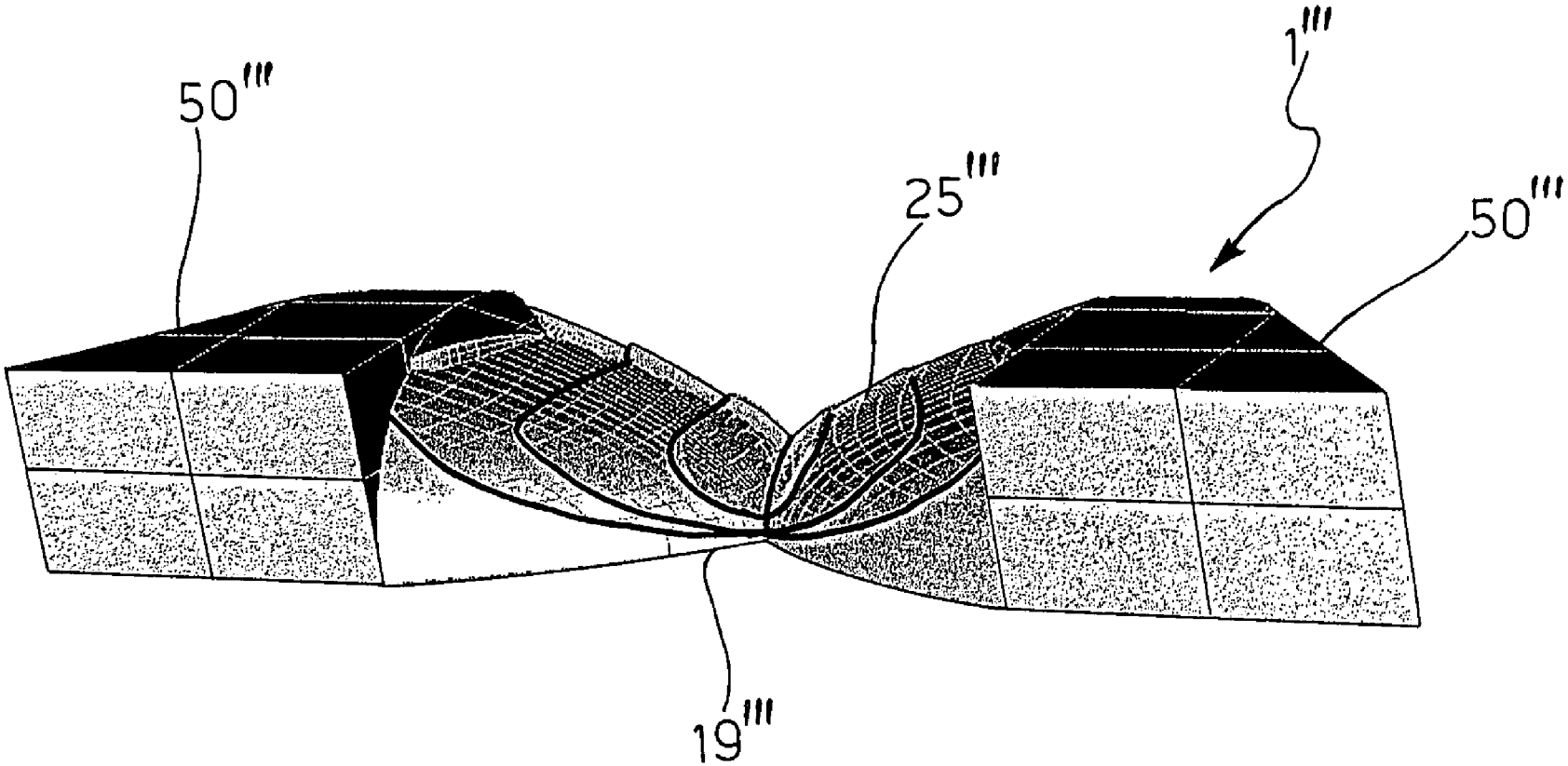
FIG. 20 is a perspective view of the device of FIG. 19.

According to a further variant, a basic module 1''' is produced by the intersection of two modules 1 of the type described above (see FIGS. 19 and 20). The basic module 1''' has a curved surface 25''' with the shape substantially of two identical and confocal semi-paraboloids of revolution having a common axis z which is intended to be arranged perpendicular to the axis of the vehicle and parallel to the road surface. These paraboloids have vertices on opposite sides of the focus and are connected to one another in the plane which is perpendicular to the axis of symmetry z and extends through the focus; the LED source 10, for example in chip form, is arranged in the region of the flat face 19''' which is formed by the sectioning of the paraboloids and is positioned approximately at the common focus of the paraboloids. Two 45° deflecting prisms 50''' are disposed at the resulting two outlets 27''' and have the function of deflecting the rays reflected by the surfaces 25''' of the module 1''' in the direction of forward movement of the vehicle, forming the distribution of luminous intensity in accordance with the standards that are in force (see FIG. 21). Each of the surfaces 25''' of the paraboloids is formed so as to follow the design principles set out above.

The advantage of this configuration lies in the fact that it is possible to avoid the need to deposit a reflective coating in the regions close to the source 10; these regions which, in the individual module, no longer had the geometrical conditions for TIR are replaced by the regions of the "twin" module.

In a further embodiment, the curved surface 25 of the device 1 adopts substantially the shape of two paraboloids of revolution arranged close together in the region of the median plane, that is, the plane which is perpendicular to the road surface and extends through the axis of revolution of the paraboloids (see FIG. 5). Each of these paraboloids is designed so as to have its focus substantially coinciding with the vertex of the emitter farthest from the vertex of the paraboloid. The light rays emitted by the region close to the vertex will thus be substantially collimated parallel to the road surfaces and to the axis of the device, whereas all of the other rays will be reflected in directions below the horizon. In this embodiment also, the curved surfaces of the paraboloids may be shaped in accordance with the design lines described above.

The embodiments described herein are intended to be considered as examples of the implementation of the invention;

however, modifications with regard to the shape and arrangement of parts and constructional and functional details may be applied to the invention, in accordance with the numerous possible variants which will seem suitable to persons skilled in the art.

What is claimed is:

1. A module for projecting a light beam, comprising a light source and a substantially flat support surface on which the source is arranged in a manner such as to emit light from only one side of the surface, and means for reflecting the light emitted by the source, wherein the reflecting means comprise a curved reflecting surface which extends on one side of the support surface and has a concavity facing towards the support surface, wherein the reflecting surface has a longitudinal section, perpendicular to the support surface, which has a substantially parabolic shape with an axis substantially parallel to the support surface, and a transverse section, parallel to the support surface, having a substantially conical curve shape, in such a way as that the reflecting surface is adapted to reflect the light coming from the source in a principal direction substantially parallel to the support surface of the source thereby generating a predetermined luminous intensity distribution, wherein the curved reflecting surface is formed by a plurality of sectors which are connected discontinuously so as to form discontinuities of profile or of curvature, wherein each sector presents predetermined values of spread of the light reflected by it in a direction perpendicular to the support surface, said sectors being delimited by isospread curves at which the spread adopts a constant value, and wherein each sector is arranged to convey the light emitted by the source in a respective zone of the luminous intensity distribution.

2. A module according to claim 1 in which the source comprises a plurality of sub-sources disposed on the support surface.

3. A module according to claim 1 in which the support surface is defined by a substrate provided with conductive tracks for connecting the source electrically to an electrical supply system.

4. A module according to claim 1, wherein said module comprises a solid body made of transparent material, comprising a first flat face which is coupled with the support surface, a curved face which defines the reflecting surface and has the shape substantially of a semi-paraboloid of revolution with axis of symmetry substantially parallel to the flat face, the source being positioned in the vicinity of the focus of the semi-paraboloid, and a second flat face of substantially semi-circular shape and substantially perpendicular to the first flat face, the first flat face adjoining the second flat face and the curved face.

5. A module according to claim 4 in which at least part of the reflecting face can reflect the light emitted by the source by total internal reflection.

6. A module according to claim 5 in which the reflecting face has a reflective coating in the zones in which the light emitted by the source falls on the curved surface at an angle less than the angle of total internal reflection.

7. A module according to claim 4 in which the source is of the solid-state type.

8. A module according to claim 7, in which the source has a covering package and the flat face, in the region of the source, a substantially cup-shaped recess which can receive the package.

9. A module according to claim 7 in which the source is incorporated in the module in the region of the flat face.

10. A module according to claim 7 in which the source is an LED having a rectangular emitter, the longer axis of the emitter being oriented perpendicularly relative to the axis of the parabola.

11. A module according to claim 4 in which the curved face is arranged for conveying the light emitted by the source in a distribution of luminous intensity having the shape of a belt which is substantially symmetrical with respect to the axis of symmetry of the semi-paraboloid and parallel to the first flat face.

12. A module according to claim 4 in which the curved face is formed by a plurality of separate sectors of surface of revolution which are connected discontinuously so as to form discontinuities of profile or of curvature, each sector being arranged to convey the light emitted by the source in a distribution of luminous intensity having the shape of a belt which is substantially symmetrical with respect to the axis of symmetry of the semi-paraboloid and parallel to the first flat face, the width of each belt being, in general, different for each sector of the curved face.

13. A module according to claim 12 in which the sectors of the curved face are paraboloid of revolution sectors, each sector having a focus in the vicinity of the source.

14. A module according to claim 12 in which each sector has an axis of revolution which is inclined to the first flat face, thus forming therewith an angle which in general is different for each sector.

15. A module according to claim 14 in which the angle of inclination of each sector is equal to half of the vertical divergence of the beam reflected by that sector.

16. A module according to claim 12 in which the second flat face is subdivided into sectors, each sector of the flat face being associated with one of the sectors of the curved face and having a prism which can tilt the beam emitted by the corresponding sector of the curved face through an angle equal to half of the divergence of the beam.

17. A module according to claim 16 in which each sector of the second flat surface has a cylindrical lens or a matrix of micro-lenses which have axes perpendicular to the first flat face and which are adapted to increase the horizontal divergence of the beam, the horizontal divergence being greater for the sectors having a greater vertical half-divergence.

18. A module according to claim 12 in which the sectors are delimited by isospread curves.

19. A module according to claim 4 in which the second flat face has a cylindrical lens which has an axis perpendicular to the first flat face and is adapted to increase the horizontal divergence of the beam.

20. A module according to claim 4 in which the second flat face has a matrix of micro-lenses which have axes perpendicular to the first flat face and which are adapted to increase the horizontal divergence of the beam.

21. A module according to claim 20 in which the matrix of micro-lenses is formed by alternately converging and diverging sinusoidal lenses connected to one another continuously both in profile and in curvature.

22. A module for projecting a light beam, comprising a pair of modules according to claim 5 arranged in a manner such that:

- their respective first fiat faces are at the same level since they are coupled with the support surface for the source, which is shared by both modules,
- their respective substantially semi-paraboloid-shaped curved faces share the same axis of symmetry and the same focus, the source being positioned in the vicinity of the common focus, and their respective vertices are positioned theoretically on opposite sides of the focus so that the semi-paraboloid faces are connected in a plane perpendicular to the axis of symmetry and extending through the focus, and their respective second fiat faces are associated with respective reflecting elements which are adapted to deflect the light beam in a substantially transverse direction relative to the axis of symmetry.

23. A module according to claim 22 in which each of the reflecting elements is formed by a prism made of transparent material, the prism being incorporated in the module in a manner such as to have a face for the entry of the light beam, which face is positioned in the region of the second face of the respective module, and a face for the output of the light beam having a predetermined inclination to the axis of symmetry.

24. A module according to claim 1, wherein said module comprises a hollow body comprising a first transparent wall having a first flat face coupled with the support surface, a second wall having a curved face which defines the reflecting surface and has the shape substantially of a semi-paraboloid of revolution with axis of symmetry substantially parallel to the flat face, the source being positioned in the vicinity of the focus of the semi-paraboloid, and a third wall which is made of transparent material, is of substantially semicircular shape, and has a second, outer fiat face substantially perpendicular to the first flat face, the hollow body being sealed and filled with a liquid or gel material having a refractive index substantially equal to the refractive index of the material constituting the walls.

25. A vehicle front light assembly comprising a plurality of modules according to claim 1.

26. An assembly according to claim 25, comprising a support plate which is shred by several modules in a manner such that the support surface of each module is substantially parallel to the road surface.

27. An assembly according to claim 26 in which the sources of the modules are arranged in a manner such as to emit light on the lower side of the support surface.

28. An assembly according to claim 26 in which there is a plurality of parallel support plates, each plate being shared by several modules.

29. An optical device which is suitable for a module according to claim 1 and which comprises a curved reflecting surface, the device being suitable for being coupled with the support surface in a manner such that the reflecting surface extends on one side of the support surface and has a concavity facing towards the support surface.

30. An optical device according to claim 29, wherein the curved reflecting surface is obtained by means of a metallic or multi-layer dielectric reflective coating on a moulded plastics shell.

31. A device according to claim 29 in which the reflecting surface has a longitudinal section, perpendicular to the support surface, which has a substantially parabolic shape with an axis substantially parallel to the coupling surface, and a transverse section, parallel to the support surface, having a substantially conical curve shape.

32. A device according to claim 29 in which the device is formed by a solid body made of transparent dielectric material comprising a first flat face which defines the support surface, a curved face which defines the reflecting surface and has the shape substantially of a semi-paraboloid of revolution with axis of symmetry substantially parallel to the flat face, a seat for the source being provided in the vicinity of the focus of the semi-paraboloid, and a second flat face of substantially semicircular shape and substantially perpendicular to the first flat face, the first flat face adjoining the second flat face and the curved face.

33. A device according to claim 32 in which the reflecting face has, at least in part, a metallic or multi-layer dielectric reflective coating.

34. A device according to claim 32 in which the curved face is formed by a plurality of separate sectors of surface of revolution which are connected discontinuously so as to form discontinuities of profile or of curvature.

35. A device according to claim 34 in which the sectors of the curved face are sectors of revolution paraboloid, each sector having a focus in the vicinity of the source.

36. A device according to claim 34 in which each sector has an axis of symmetry which is inclined to the first flat face, thus forming therewith an angle which in general is different for each sector.

37. A device according to claim 34 in which the second flat face is subdivided into sectors, each sector of the flat face being associated with one of the sectors of the curved face and having a prism having a predetermined inclination to the flat face.

38. A device according to claim 29 in which the device is formed by a hollow body comprising a first transparent wall having a first fiat face which defines the support surface, a second wall having a curved face which defines the reflecting surface and has the shape substantially of a semi-paraboloid of revolution with axis of symmetry substantially parallel to the flat face, a seat for the source being provided in the vicinity of the focus of the semi-paraboloid, and a third wall which is made of transparent material, is of substantially semicircular shape, and has a second, outer flat face substantially perpendicular to the first flat face, the hollow body being sealed and filled with a liquid or gel material having a refractive index substantially equal to the refractive index of the material constituting the walls.

* * * * *